US008021518B2

(12) United States Patent
Furman et al.

(10) Patent No.: US 8,021,518 B2
(45) Date of Patent: Sep. 20, 2011

(54) METHOD OF APPLYING A SUPER-ABSORBENT COMPOSITION TO TISSUE OR TOWEL SUBSTRATES

(75) Inventors: Gary S. Furman, St. Charles, IL (US); Laurence S. Bonday, Chicago, IL (US); Shiby John, Naperville, IL (US)

(73) Assignee: Nalco Company, Naperville, IL (US)

( * ) Notice: Subject to any disclaimer, the term of this patent is extended or adjusted under 35 U.S.C. 154(b) by 467 days.

(21) Appl. No.: 11/564,946

(22) Filed: Nov. 30, 2006

(65) Prior Publication Data

US 2008/0128101 A1 Jun. 5, 2008

(51) Int. Cl.

| | |
|---|---|
| ***D21H 23/24*** | (2006.01) |
| ***D21H 19/82*** | (2006.01) |
| ***D21H 21/22*** | (2006.01) |
| ***D21H 17/33*** | (2006.01) |

(52) U.S. Cl. ..... 162/184; 162/135; 162/137; 162/164.1; 162/164.3; 162/168.1; 162/207; 34/444; 427/391

(58) Field of Classification Search ..... 162/109, 162/111–113, 158, 204–207, 9, 157.6, 202, 162/182–184, 135–137, 164.1, 168.3, 168.1; 34/443–446, 448, 451, 487; 427/358, 361, 427/391, 362, 420, 421.1, 428.01

See application file for complete search history.

(56) References Cited

U.S. PATENT DOCUMENTS

| | | | | |
|---|---|---|---|---|
| 3,056,213 | A * | 10/1962 | Kellogg | 34/422 |
| RE28,459 | E * | 7/1975 | Cole et al. | 34/306 |
| 4,090,013 | A | 5/1978 | Ganslaw et al. | |
| 4,462,868 | A * | 7/1984 | Oubridge et al. | 162/280 |
| 4,523,390 | A * | 6/1985 | McCarthy | 34/115 |
| 4,914,170 | A | 4/1990 | Chang et al. | |
| 5,126,382 | A | 6/1992 | Hollenberg | |
| 5,389,204 | A * | 2/1995 | Ampulski | 162/135 |
| 5,425,852 | A * | 6/1995 | Joiner | 162/290 |
| 5,465,504 | A * | 11/1995 | Joiner | 34/446 |
| 5,569,359 | A * | 10/1996 | Joiner | 162/206 |
| 5,693,707 | A | 12/1997 | Cheng et al. | |
| 5,784,804 | A * | 7/1998 | Nowakowski | 34/446 |
| 5,795,439 | A * | 8/1998 | Euripides et al. | 162/100 |
| 6,154,981 | A * | 12/2000 | Heikkila et al. | 34/451 |
| 6,484,418 | B1 * | 11/2002 | Hada et al. | 34/487 |
| 6,686,414 | B1 | 2/2004 | Anderson et al. | |
| 6,770,576 | B2 * | 8/2004 | Cook et al. | 442/59 |
| 6,951,911 | B2 * | 10/2005 | Tagawa et al. | 526/317.1 |
| 6,979,386 | B1 * | 12/2005 | Wallajapet et al. | 162/109 |
| 6,984,419 | B2 | 1/2006 | Anderson et al. | |
| 7,399,378 | B2 * | 7/2008 | Edwards et al. | 162/111 |

(Continued)

FOREIGN PATENT DOCUMENTS

EP 0992250 A2 12/2000

(Continued)

*Primary Examiner* — Jose A Fortuna

(74) *Attorney, Agent, or Firm* — Benjamin E. Carlsen; Edward O. Yonter; Michael B. Martin

(57) ABSTRACT

The invention provides a method of increasing the absorbency of an absorbent article. The method includes introducing a super-absorbent polymer composition to a paper web in a papermaking process to increase the absorbent capacity of an absorbent article made in the process. The polymer composition includes a super-absorbent polymer and a cross-linking agent applied to the paper web. The paper web is then subjected to heat in a heated drum or a through-air drier to cure or cross-link the super-absorbent polymer.

22 Claims, 5 Drawing Sheets

U.S. PATENT DOCUMENTS

| | | | | |
|---|---|---|---|---|
| 7,435,312 | B2 * | 10/2008 | Lindsay et al. | 162/109 |
| 2004/0123963 | A1 * | 7/2004 | Chen et al. | 162/134 |
| 2004/0238135 | A1 * | 12/2004 | Edwards et al. | 162/111 |
| 2005/0167874 | A1 * | 8/2005 | Larsson et al. | 264/122 |
| 2005/0224200 | A1 * | 10/2005 | Bouchard et al. | 162/123 |
| 2006/0035557 | A1 | 2/2006 | Anderson et al. | |
| 2007/0137808 | A1 * | 6/2007 | Lostocco et al. | 162/109 |
| 2007/0137810 | A1 * | 6/2007 | Dyer et al. | 162/109 |
| 2007/0204966 | A1 * | 9/2007 | Chou et al. | 162/199 |
| 2008/0034606 | A1 * | 2/2008 | Deem et al. | 34/115 |
| 2008/0128101 | A1 * | 6/2008 | Furman et al. | 162/158 |

FOREIGN PATENT DOCUMENTS

| | | | |
|---|---|---|---|
| IT | 1304848 | B1 | 4/2001 |
| WO | WO 9518264 | A1 * | 7/1995 |
| WO | WO 9957367 | A1 * | 11/1999 |
| WO | WO 0038607 | A1 * | 7/2000 |
| WO | WO 0114641 | A1 | 3/2001 |
| WO | WO 0179314 | A1 * | 10/2001 |
| WO | WO 0242559 | | 5/2002 |
| WO | WO 2008067243 | A1 * | 6/2008 |

* cited by examiner

METHOD OF APPLYING A SUPER-ABSORBENT COMPOSITION TO TISSUE OR TOWEL SUBSTRATES

TECHNICAL FIELD

This invention relates generally to a method of increasing the absorbency of an absorbent article. More specifically, the invention relates to a method of applying a super-absorbent composition to an absorbent article. The invention has particular relevance to a method of applying a super-absorbent composition including a cross-linkable polymer and a cross-linking agent to a paper web in a papermaking process to increase absorbency of an absorbent article formed from the paper web.

BACKGROUND

Absorbency is a primary end-use property of tissue and towel products. Tissue and towel producers may capitalize upon increases in absorbency to market new and improved products or to reduce the amount of cellulose fiber used to achieve a certain level of absorbency. Super-absorbent materials have been developed that increase the absorbency of absorbent articles, such as tissue and towel products. For example, super-absorbent polymers (sometimes collectively referred to herein as "SAP") are used in many industries and applications, such as medical, food, and agricultural industries. These materials also have utility in many consumer products including disposable absorbent articles, such as diapers, incontinent pads, feminine care products, tissues, and paper towels. SAPs are typically capable of absorbing 30 to over 200 times their weight in fluid. For certain applications, the trend is to provide thinner, more compact absorbent articles, which is generally contingent on the ability to develop relatively thin absorbent cores that can absorb, distribute, and store large quantities of fluid.

Although certain other polymer types provide super-absorbent properties, the predominant commercial products are partially neutralized, cross-linked polyacrylic acids, partly because of their cost efficiency. Some factors affecting super-absorbent capacity of such polymers include hydrophilicity, degree of cross-linking, and presence of dissociated ions. Hydrophilic polymers are used because they hydrate well and effectively form hydrogen bonds with water. Cross-linking is important because it prevents infinite swelling and eventual polymer dissolution. Too much cross-linking generally restricts swelling and thus decreases performance. Presence of ions provide charge repulsion to help the polymer matrix expand and also drive osmotic pressure effects to force more water into the polymer matrix.

Examples of SAPs include polyacrylates and their sodium, potassium, and lithium salts and polyacrylamide with a potassium salt base (e.g., EP 0992250 A2 and U.S. Pat. No. 6,984,419 B2). SAPs are typically designed to resist humidity, but will swell when put in intimate contact with water. They are usually prepared by either one of two methods. The first method involves sufficiently cross-linking emulsion or aqueous solution polymers to make them water insoluble, while retaining their ability to swell in water. The second method is modifying water-insoluble polymers with pendant hydrophilic groups to induce swelling when in contact with water.

SAPs are available in a particulate or powder form. In the case of diaper construction, SAPs are sifted into the absorbent core. The absorbent core is sandwiched between a fluid pervious topsheet and a fluid impervious backsheet. The incorporation of particulate SAP tends to generate dust from the SAP fines. Further, conventional absorbent articles have the limitation of the SAP not being sufficiently immobilized and are thus free to migrate and shift during the manufacturing process, shipping/handling, and/or use. Movement of the SAP particles during manufacture can lead to handling losses as well as improper distribution of the particles.

Powdered form SAPs need to be applied to a dry substrate thus necessitating a converting operation. SAPs do not bind well to a dry sheet, which creates a new set of problems when attempting to localize or evenly disperse the SAP. Absorbency problems also occur when the SAP particles migrate prior to, during, and after swelling. This inability to fix the particles at optimum locations leads to insufficient fluid storage in one area and over-capacity in other areas.

The fluid transport properties of the gel layer formed as a result of the swelling SAP particles in the presence of fluids is extremely important. Although the formation of a SAP gel layer fluid barrier, known as "gel blocking" is desirable for some applications, such as for use in cables, the formation of gel layers in disposable absorbent products is undesirable since it greatly reduces the efficiency of the SAP and causes "sliminess" or "clumpiness" when wetted. Thus, the advantages of being able to fixate SAP particles in place are apparent and several ways of accomplishing such have been suggested.

There are many cross-linkable water soluble/swellable polyacrylate-based compositions. However, consistent with the fact that commercially available SAP tends to be in granular, particulate, or powdered form, the impetus of the prior art is aimed at making highly viscous emulsions and dispersions that are subsequently dried, masticated, pulverized, or ground to the desired size. For example, U.S. Pat. No. 4,914,170 relates to super-absorbent polymeric compositions prepared from a monomer including acrylic acid and a second hydrophilic monomer, which can be a soluble salt of beta-acryloxypropionic acid. The pH of the aqueous monomer solution is typically adjusted to substantially exclude free acid, and the aqueous monomer solution is coated onto a heated surface to both polymerize the monomer and dry the resulting hydrogel.

As industry recognized the deficiencies of particulate SAPs, aqueous based super-absorbent polymer compositions began to be developed. With the advent of better super-absorbent polymers, a need exists to develop methods of using these polymers. In particular, a need exists to develop methods of incorporating these polymers into tissue, paper towel, and other absorbent substrates to increase their absorptive capacity.

SUMMARY

Accordingly, this invention provides a method of increasing absorbency of an absorbent article. A paper web is prepared for use in a papermaking process and, in an embodiment, the paper web has from about 15 percent to about 95 percent consistency. The method includes introducing a super-absorbent polymer composition to the paper web in the papermaking process. The super-absorbent composition includes a cross-linkable polymer and, in an embodiment, has a viscosity from about 200 cPs to about 2000 cPs. Representative papermaking processes include a dry crepe process, a wet crepe process, a creped through-air dried process, or an uncreped through-air dried process. The method includes one or a plurality of super-absorbent composition application points and introducing the super-absorbent composition to the paper web at one or more of the application points.

In one embodiment, the method includes providing one or more super-absorbent composition application points in a papermaking process. In an embodiment, a paper web is transferred to a heated drum including at least one of the super-absorbent composition application points. In another embodiment, the paper web is contacted with one or more through-air driers including at least one of the super-absorbent composition application points. In another embodiment, the paper web is contacted with one or more after-driers including at least one of the super-absorbent composition application points. The method further includes introducing a super-absorbent composition to the paper web to form a treated paper web at one or more of the application points.

In one aspect the method includes providing a papermaking process including a heated drum partially surrounded by a wet end hood and partially surrounded by a dry end hood. In an embodiment, the heated drum includes a first super-absorbent composition application point before the wet end hood. In one embodiment, the papermaking process includes one or more after-driers, where one of the after-driers has a second super-absorbent composition application point. Alternatively, one, two, or more of the after-driers has an associated super-absorbent composition application point.

In one embodiment an effective amount of the super-absorbent composition is introduced to the paper web at the first super-absorbent composition application point to form a treated paper web. In another embodiment, the method includes introducing an effective amount of the super-absorbent composition at the second super-absorbent composition application point to form the treated paper web. In a further embodiment, the method includes introducing an effective amount of the super-absorbent composition at the first super-absorbent composition application point to form the treated paper web and reintroducing an effective amount of the super-absorbent composition to the treated paper web at the second super-absorbent composition application point.

In an embodiment, a first surface of the paper web is in contact with the heated drum and a second surface of the paper web is not in contact with the heated drum. In one embodiment, the method includes introducing an effective amount of the super-absorbent composition to the second surface of the paper web to form the treated paper web. In another embodiment, a first side of the paper web is in contact with each after-drier and a second side of the paper web is not in contact with each after-drier. The method includes introducing an effective amount of the super-absorbent composition to the first side of the paper web to form the treated paper web, in accordance with an embodiment.

In another aspect, the invention includes providing one or more through-air driers including at least one super-absorbent composition application point and optionally contacting a paper web with one or more through-air driers prior to the application point. In an embodiment, the method includes introducing an effective amount of the super-absorbent composition to the paper web to form a treated paper web at the super-absorbent composition application point. In another embodiment, the method includes reintroducing an effective amount of the super-absorbent composition to the treated paper web at another one of the super-absorbent composition application points, if any. In an embodiment, the method includes a first side of the paper web in contact with each through-air drier and a second side of the paper web not in contact with each through-air drier, and introducing an effective amount of the super-absorbent composition to the first side of the paper web.

If the papermaking process includes one or more through-air driers, the method includes contacting the paper web with the through-air drier for a period and, in one embodiment, introducing the super-absorbent composition to the paper web before the period to form a treated paper web. In another embodiment, the method includes introducing the super-absorbent composition to the paper web before the period to form the treated paper web and then contacting the treated paper web with the through-air drier for the period. In an embodiment, the treated paper web has from about 50 percent to about 95 percent consistency after the period.

In a further aspect, the method includes increasing absorbency of an absorbent article produced in a wet crepe papermaking process. In an embodiment, this aspect includes preparing a paper web having from about 30 percent to about 45 percent consistency. The paper web is then transferred to a first heated drum and creped. The paper web typically has from about 70 percent to about 90 percent consistency after creping according to an embodiment. The paper web is optionally transferred to one or more additional heated drums, including at least one subsequent heated drum. A first side of the paper web is in contact with the subsequent heated drum and a second side of the paper web is not in contact with the subsequent heated drum after transferring the paper web to the subsequent heated drum. An effective amount of the super-absorbent composition is introduced to the first side of the paper web to form the treated paper web.

Alternatively, an effective amount of the super-absorbent composition is introduced to the first side of the paper web or the second side of the paper web to form the treated paper web and then the paper web is transferred to the subsequent heated drum. In an embodiment, this aspect includes transferring the treated paper web to one or more additional heated drums. In another embodiment, the paper web is transferred to another subsequent heated drum where the super-absorbent composition is reintroduced to the treated paper web in a similar fashion as for the first subsequent heated drum.

In an additional aspect the invention provides a method of increasing absorbency of an absorbent article produced in an uncreped through-air dried papermaking process. The method includes preparing a paper web typically having, in an embodiment, from about 15 percent to about 70 percent consistency. According to an embodiment, the paper web is contacted with one or more through-air driers, where at least one of the through-air driers has one or more associated super-absorbent composition application points. The super-absorbent composition is introduced to the paper web to form a treated paper web before or after contacting the through-air driers. In an embodiment, the treated paper web is contacted with one or more additional through-air driers. In another embodiment, the super-absorbent composition is reintroduced to the treated paper web.

It is an advantage of the invention to provide a method of applying a super-absorbent polymer composition to a paper web to increase absorbency of an absorbent article formed from the paper web.

It is another advantage of the invention to provide a tissue, paper towel, or other absorbent product having increased absorptive capacity.

A further advantage of the invention is to provide an absorbent article having from about 5 percent to about 65 percent increased absorbent capacity.

An additional advantage of the invention is to improve the absorbent capacity of an absorbent article by as much as 30 percent with an add-on level of super-absorbent composition as low as 0.5 weight percent, based on dry solids.

Another advantage of the invention is to provide a method of improving the absorbent capacity of an absorbent article by as much as 10 percent with an add-on level of super-absorbent composition as low as 0.1 weight percent based on dry solids.

It is a further advantage of the invention to provide a method of increasing absorbent capacity of an absorbent article without decreasing its absorbent rate.

It is yet another advantage of the invention to provide a method of applying a super-absorbent composition in the formation of an absorbent article that has a variable application or feed point, an efficient feed system, and minimal impact on machine runnability, sheet creping, sheet control, breaks, edge build-up, and drying load.

A further advantage of the invention is to provide an economical method of increasing absorbency of absorbent articles produced using a wet crepe papermaking process or a dry crepe papermaking process.

Another advantage of the invention is to provide a cost-effective method of increasing absorbency of absorbent articles produced in a creped through-air dried papermaking process or an uncreped through-air dried papermaking process.

An additional advantage of the invention is to provide increased absorbency without a measurable increase in fiber content or basis weight of the absorbent article.

DETAILED DESCRIPTION

Figure 1:
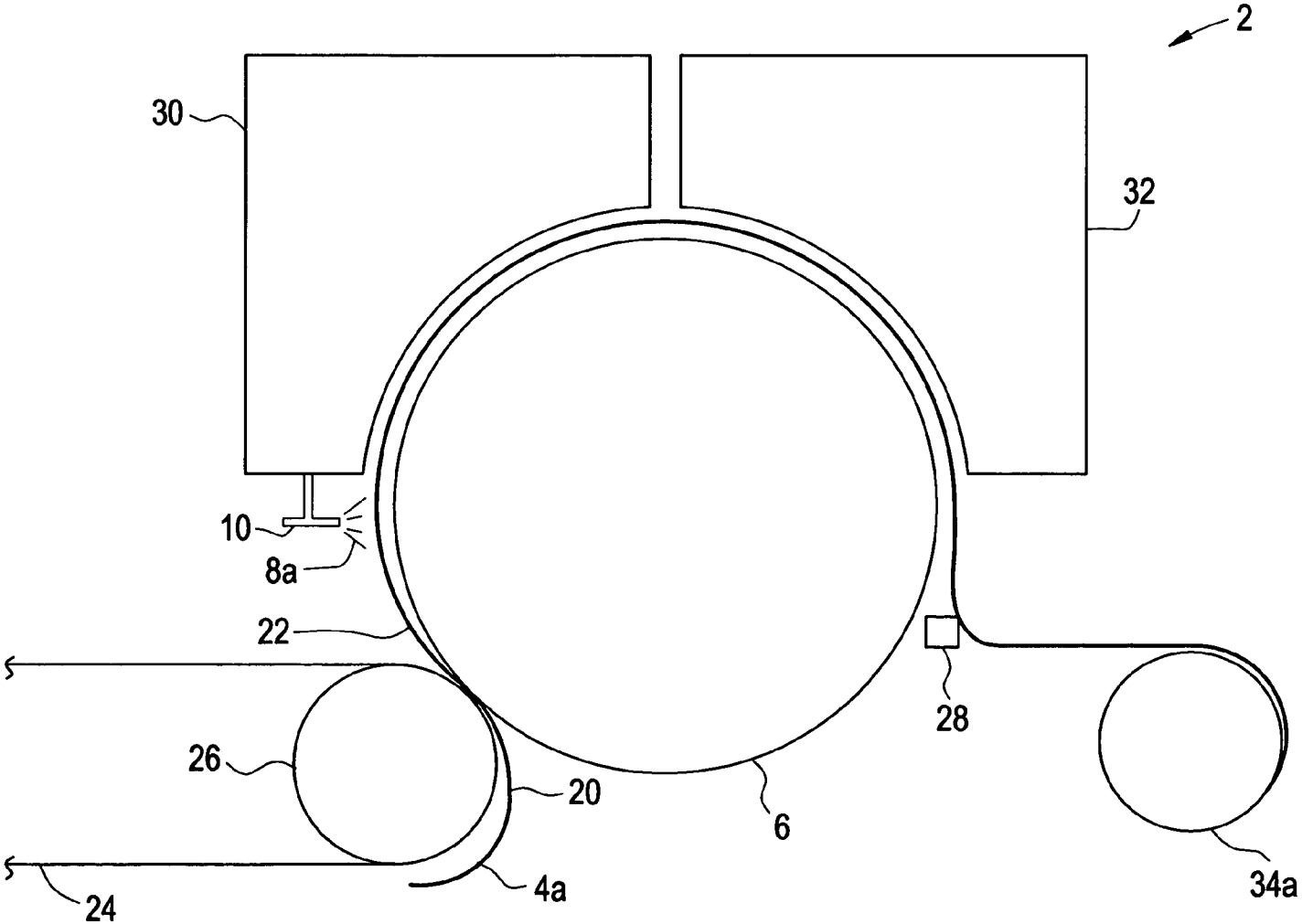
FIG. 1 illustrates an embodiment of the method with a side view of a simplified dry crepe papermaking process having a spray nozzle apparatus attached to the wet end hood.

A super-absorbent composition (sometimes referred to herein as "SAP") may be applied to a substrate to increase the hygroscopicity/humectancy of an article made from the substrate or for the purpose of manufacturing super-absorbent fibers having enhanced absorbent properties. It is contemplated that a variety of super-absorbent polymers may be used in the invention. Non-limiting examples of representative polymers are described below. Examples of useful substrates (i.e., paper webs) include natural cellulose fibers, such as wood pulp, cotton, silk, and wool; synthetic fibers, such as nylon, rayon, polyesters, acrylics, polypropylenes, polyethylene, polyvinyl chloride, polyurethane, and glass; and the like. The super-absorbent products may be used in many applications including absorbent cores in disposable absorbent products, as well as other absorbent products, such as paper towels, facial tissue, toilet paper, sanitary products, meat-packing absorbents, and the like.

Super-Absorbent Composition

A preferred cross-linkable super-absorbent polymer for use in the method of the invention is disclosed in U.S. Pat. No. 6,984,419 B2 (incorporated herein by reference in its entirety). The polymer composition is produced from the solution polymerization of one or more water-soluble monomers. In one embodiment, the composition includes an aqueous medium of about 5 weight percent to about 65 weight percent solids of a polymer prepared by an aqueous solution polymerization of one or more water soluble monomers, as explained below. Preferably the aqueous solution includes about 10 weight percent to about 50 weight percent solids. More preferably, the solution includes about 20 weight percent to about 40 weight percent solids. Preferred water soluble monomers include α,β-ethylenically unsaturated monocarboxylic acids or dicarboxylic acids and acid anhydrides, such as acrylic acid, methacrylic acid, crotonic acid, maleic acid/anhydride, itaconic acid, aconitic acid, mesaconic acid, fumaric acid, the like, and any combinations. Acrylic acid is the most preferred. In alternative embodiments, the polymers may be homopolymers, copolymers, or terpolymers.

The polymerization of such monomers produces an alkali soluble polyelectrolyte. Small amounts of other monomers, having variable water solubility, may be incorporated. It is contemplated that small amounts of water insoluble monomers will typically not affect the intended properties of the polymer before and/or after cross-linking. Examples include 2-hydroxyethylacrylate, 2-hydroxyethylmethacrylate, vinyl pyrolidone, acrylamide, methacrylamide, sodium vinyl sulfonate, 1-allyl-oxy-2-hydroxypropane sulfonate, and the like.

Once polymerized, the aqueous composition, in an embodiment, is adjusted to a pH of about 7 to about 11 using an alkali metal hydroxide, such as sodium hydroxide or potassium hydroxide, and/or an alkaline earth metal hydroxide, such as calcium hydroxide. Other representative metal hydroxides include those having alkaline metals, alkaline earth metals, first row transition metals, second row transition metals, lanthanides, the like, and combinations thereof. In certain embodiments, a metal alkoxide can be used in place of the metal hydroxide.

In an embodiment, the super-absorbent polymer may be selected from polyacrylate polymers and their sodium, lithium, or potassium salts. In this embodiment, a suitable polyacrylate typically has a molecular weight of at least 150,000, and preferably as high as 190,000, 220,000, or more. Any free radical generating source, such as peroxides and persulfates, may be used to initiate the polymerization of the monomers and carry out the polymerization well known to those skilled in the art. Further, chain transfer agents known in the art may be employed to alter the molecular weight for any of the super-absorbent polymers used in the invention.

In a preferred embodiment, from about 50 percent to about 95 percent of the acid groups in the polymer are neutralized, more preferably about 65 percent to about 85 percent are neutralized, and most preferably about 75 percent of the acid groups are neutralized with an alkali metal hydroxide. In one embodiment, the neutralized polymer is further neutralized with a volatile alkaline base. Upon application of the SAP, the volatile base dissipates thereby liberating a portion of the carboxylate groups to the free acid form. This liberation allows for more efficient polymer cross-linking.

The viscosity of the aqueous polymer solution ranges from about 50 cPs to about 50,000 cPs and more typically from about 100 cPs to about 30,000 cPs. Preferably, the composition is from about 100 cPs to about 20,000 cPs, more preferably from about 100 cPs to about 10,000 cPs, even more preferably from about 100 cPs to about 5,000 cPs, and most preferably from about 100 cPs to about 2,000 cPs. If the viscosity is too high, the polymer solution is difficult to handle and process, whereas if the viscosity is too low, the ability to absorb fluid is substantially diminished. It is most preferred that the aqueous polymer is sufficiently low in viscosity such that the composition may be applied as described below. The aqueous, alkaline solution viscosity, as a function of percent solids, corresponds to the molecular weight of the polymer.

Viscosity may be adjusted in a variety of ways including by adding additional processing agents or heating. Preferred methods of optimizing viscosity include heating the SAP composition to achieve a viscosity of less than 600 cps. The preferred method of heating is to heat the SAP composition with an in-line booster heater as the SAP composition is being pumped to the spray boom from a reservoir or feed tank. Temperatures in the range from about 30° C. to about 60° C. are usually sufficient. Higher temperatures typically result in lower viscosities. Alternatively, an inert salt, such as NaCl or the like, may be added to the SAP composition at levels from about 1 weight percent to about 10 weight percent of the composition in order to lower the viscosity. A combination of heating and salt addition can also be used to lower the viscosity of the SAP composition to a level that provides for optimized spray addition.

In another embodiment, the super-absorbent composition includes adding a polyhydroxylate in a range up to 80 weight percent, based on an alkali soluble polyelectrolyte in emulsion or solution (an example of such a polymer is disclosed in U.S. Pat. No. 5,126,382, incorporated herein by reference in its entirety). The super-absorbent polymer of this embodiment includes an emulsion of polyacrylic acid in water to which about 50 weight percent to about 80 weight percent saccharide in solution or in dry granules and a metal ion cross-linker (explained in more detail below) are added and mixed. The metal acts to cross-link the hydroxyl groups of the saccharide and ties it to the large cross-linked polymer. The pH of the solution is neutralized, if necessary, by the addition of one or more volatile bases, such as ammonium hydroxide, ammonium carbonate, or other suitable base. The resultant mixture may optionally be dried for storage.

The super-absorbent polymer solution typically possesses sufficient wet adhesion to adhere to the paper web. Optimizing the molecular weight, concentration, and degree of cross-linking in the SAPs of the invention results in a composition that has a high absorptive capacity and a fast liquid acquisition rate. In some embodiments, it is desirable to increase the adhesiveness and/or cohesiveness of the SAP solution. The composition may be combined with compatible adhesive emulsion polymers. Representative emulsion polymers include, acrylics, vinyl acrylics, styrene acrylics, styrene butadiene rubber (SBR), vinyl acetate-versatic acid esters, vinyl acetate-ethylene (VAE), and the like. For such embodiments, the aqueous super-absorbent solution may be combined with the adhesive emulsion at ratios ranging from about 95:5 to about 5:95, preferably from about 5:1 to about 1:2, and most preferably from about 1:1 to about 2:1.

To effect cross-linking of the polymer through its functional groups (e.g., carboxylic acid groups) and thus create a super-absorbing cross-linked polymer, an effective amount of a cross-linking agent is added to the aqueous polymer composition. Suitable cross-linking agents include any substance that will react with the hydrophilic groups of the aqueous solution polymer. The selection and concentration of the cross-linking agent will affect the absorbent rate and capacity. It is desirable that the cross-linking agent employed "reacts" with the functional groups on the polymer.

Although any of the variety of known cross-linking agents may be employed, such as those described in U.S. Pat. No. 4,090,013 (incorporated herein by reference in its entirety). The use of zirconium ions alone or admixed with ferric aluminum, chromic, or titanium ions as well as aziridine has been found to be particularly useful. Preferred cross-linking agents are ammonium zirconyl carbonate and potassium zirconium carbonate (commercially available as Bacote 20® and Zirmel 1000®, respectively, from Magnesium Elektron, Inc. in Flemington, N.J.). The aziridine cross-linking agent is available as Neocryl® CX-100 from DSM NeoResins in Wilmington, Mass.

The cross-linking agent is added to the polymer solution at a concentration range from about 1 weight percent to about 10 weight percent, preferably from about 2 weight percent to about 8 weight percent, and most preferably from about 3 weight percent to about 5 weight percent, based on cross-linkable polymer. The cross-linking agent is preferably introduced to the paper web as part of the super-absorbent composition, but may also be introduced to the paper web separately from the super-absorbent composition, either sequentially or simultaneously.

Preferred cross-linking agents include aluminum salts; chromium salts; titanium salts; iron salts; ammonium zirconium salts, such as zirconium carbonate, potassium zirconium carbonate; epihalohydrins; dialdehydes; and glycidyl ethers. Other suitable cross-linking agents include polyhaloalkanols, such as 1,3-dichloroisopropanol, 1,3-dibromoisopropanol; sulfonium zwitterions, such as the tetrahydrothiopene adduct of novolac resins; haloepoxyalkanes, such as epichlorohydrin, epibromohydrin, 2-methyl epichlorohydrin, and epiiodohydrin; polyglycidyl ethers, such as glycerine diglycidyl ether, ethylene glycol diglycidyl ether, propylene glycol diglycidyl ether, and diethylene glycol diglycidyl ether; derivatives thereof; the like; and mixtures thereof.

In some embodiments, such as when certain polyacrylates are used as the super-absorbent polymer, zirconium-based cross-linkers having a valence of plus four are advantageous. Representative zirconium-based cross-linking agents include ammonium zirconium carbonate, zirconium acetylacetonate, zirconium acetate, zirconium carbonate, zirconium sulfate, zirconium phosphate, potassium zirconium carbonate, zirconium sodium phosphate, sodium zirconium tartrate, the like, and combinations thereof.

As mentioned previously, the extent of cross-linking is critical to the absorbent properties of the polymer. For example, at increased cross-linking agent concentrations, the polyacrylate cross-links to a greater extent increasing the total fluid holding capacity under load. Conversely, at low cross-linking agent concentrations, the total absorbent capacity under load is reduced. Further, the viscosity affects the ease of application. An optimum balance of cross-linking and viscosity serves to obtain a super-absorbent polymer that is highly absorbent, possesses a fast rate of acquisition, and is sufficiently low enough in viscosity such that it can readily be applied in an aqueous form.

The cross-linked polymer typically absorbs about 50 to 200 times the weight of the polymer in water. Under normal atmospheric conditions, where the relative humidity ranges, for example, from 20 percent to 85 percent, the dried polymer is typically translucent and flexible due to its hydroscopic nature and propensity to be in equilibrium with the moisture content of its environment. In preferred embodiments, the cross-linked polymer absorbs at least about 5 weight percent preferably at least about 10 weight percent, and more preferably at least about 20 weight percent of moisture from the air at ambient temperature and about 50 percent relative humidity.

Method of Application

In addition to applying the super-absorbent composition having the cross-linkable polymer and cross-linking agent as a mixture, the polymer can be applied separately from the application of the cross-linking agent in a two-part process. Such application may be sequential or simultaneous, in any order. Prior to applying the composition, one or more pH-adjusting agents may be added to the composition, such as sodium hydroxide, potassium hydroxide, ammonium hydroxide, hydrochloric acid, sulfuric acid, phosphoric acid, formic acid, citric acid, the like, and combinations thereof. A preferred pH range for the composition is from about 5 to about 12. A more preferred pH for the composition is from about 8 to about 10.

Referring to FIGS. 1 to 5, the papermaking processes in which the invention may be implemented include many other components and features commonly found and used in papermaking processes. These illustrations show parts of the processes that are related to implementing the method of the invention. It is envisioned that any other components and features, without limitation, may be utilized in conjunction with the method of the invention.

A preferred method of implementing the invention includes introducing the super-absorbent polymer composition to a paper web from application point 8*a* in dry creping process 2, as illustrated in FIG. 1. The paper web travels along path 4*a* and is transferred from fabric 24 onto heated drum 6 (i.e., "Yankee Dryer" or "creping cylinder") via pressure roll 26. The paper web has surface 20, which is in contact with the heated drum after transfer and surface 22, which is not in contact with the heated drum after transfer. Application point 8*a*, in this embodiment attached to wet end hood 30 via attachment device 10, is associated with the heated drum and sprays an effective amount of the super-absorbent polymer onto surface 22 of the paper web before the paper web enters the wet end hood.

Typical temperatures in the wet end hood and dry end hood 32 range from about 400° F. to about 1100° F. A more common and preferred range is from about 600° F. to about 900° F. After the polymer-treated paper web passes through the wet end hood and passes through the dry end hood, creping blade 28 crepes the paper web. "Creping" refers to an intentional wrinkling of a paper web during drying to produce a soft, elastic sheet of tissue paper. The creping blade is typically loaded against the heated drum and is used to intentionally wrinkle or crepe the paper web. The creped paper web may then be further processed. In one embodiment, the creped paper web is collected on roll 34*a*.

In such a dry crepe papermaking process, the paper web usually has from about 15 percent to about 95 percent consistency before entering the wet end hood and is essentially dry (e.g., about 90 percent to about 98 percent consistency) after creping. "Consistency" means weight percent dry solids, which is the quotient of dry solids and dry solids plus liquid. In a preferred embodiment, the paper web has from about 30 percent to about 45 percent consistency at the time of being transferred to the Yankee Dryer.

Figure 2:
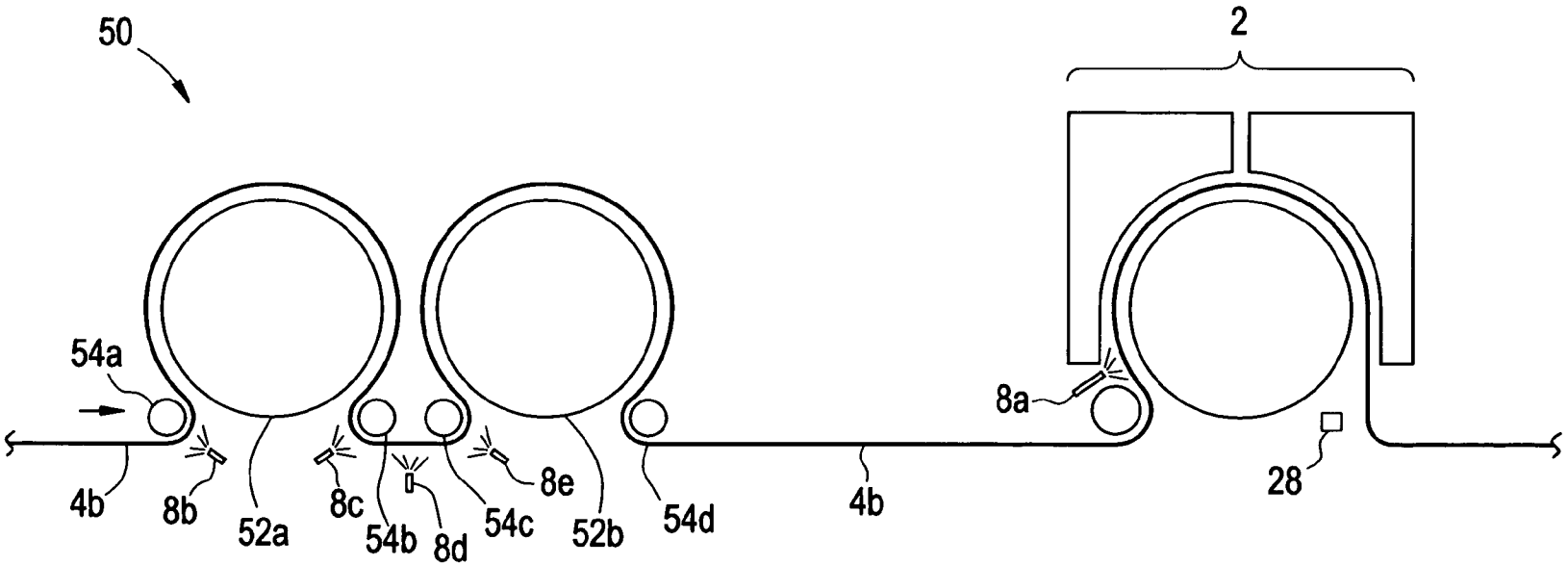
FIG. 2 is a simplified side view diagram of a creped through-air dried papermaking process that illustrates an embodiment of the invention.

A similar process is creped through-air drying ("CTAD") process 50, an embodiment of which is illustrated in FIG. 2. Implementing the invention in the CTAD process includes passing the paper web through path 4*b*. The paper web travels along the path over guide rollers 54*a* to 54*d* and over through-air driers 52*a* and 52*b*. In one embodiment, the CTAD process may utilize only one through-air drier. In a preferred embodiment, the CTAD process uses two through-air driers. Though FIG. 2 illustrates 2 through-air driers, in alternative embodiments, the CTAD process may include one, two, or more through-air driers. The super-absorbent composition may be applied at one or more application points 8*a* to 8*e*. The preferred point of application is 8*c*, 8*d*, or 8*e*, prior to the last (or only) through-air drier.

In a typical CTAD process, the paper web has from about 15 to about 25 percent consistency prior to contacting the through-air drier(s). After passing through the through-air drier(s) and prior to being transferred to the Yankee Dryer, the paper web generally has from about 50 percent to about 95 percent consistency. Upon removal from the Yankee Dryer, the creped paper web is essentially dry and has from about 90 percent to about 98 percent consistency.

Figure 3:
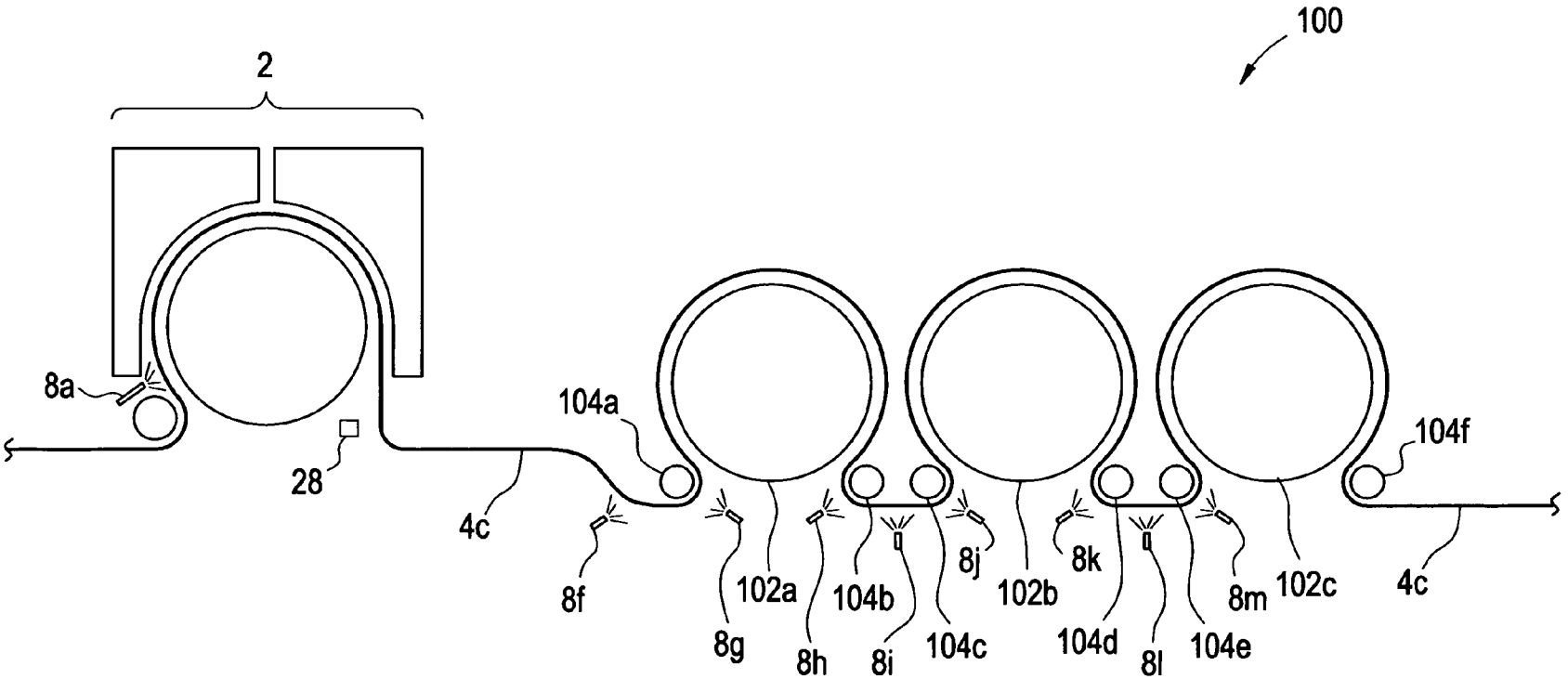
FIG. 3 depicts an embodiment of a method of applying the super-absorbent composition in a simplified side view depiction of a wet crepe papermaking process.

Referring to wet crepe papermaking process 100 as illustrated in FIG. 3, the creped paper web travels along path 4*c*. After creping the paper web at Yankee Dryer 2, the creped paper web is contacted with one or more heated drums 102*a* to 102*c*. In alternative embodiments, the wet creping process may include one, two, or up to 6 or more heated drums (i.e., after driers) with associated guide rollers 104*a* to 104*f*. The super-absorbent composition is introduced to the paper web at one or more of application points 8*f* to 8*m* and/or at application point 8*a* at the Yankee Dryer. Preferably, the point of introduction is point 8*f* or 8*g*, prior to the first heated drum. In this embodiment, the paper web typically has from about 30 percent to about 45 percent consistency prior to entering the Yankee Dryer. After the Yankee Dryer and before the after driers, the paper web generally has from about 70 percent to about 90 percent consistency and is essentially dry having from about 90 percent to about 98 percent consistency after the after driers.

Figure 4:
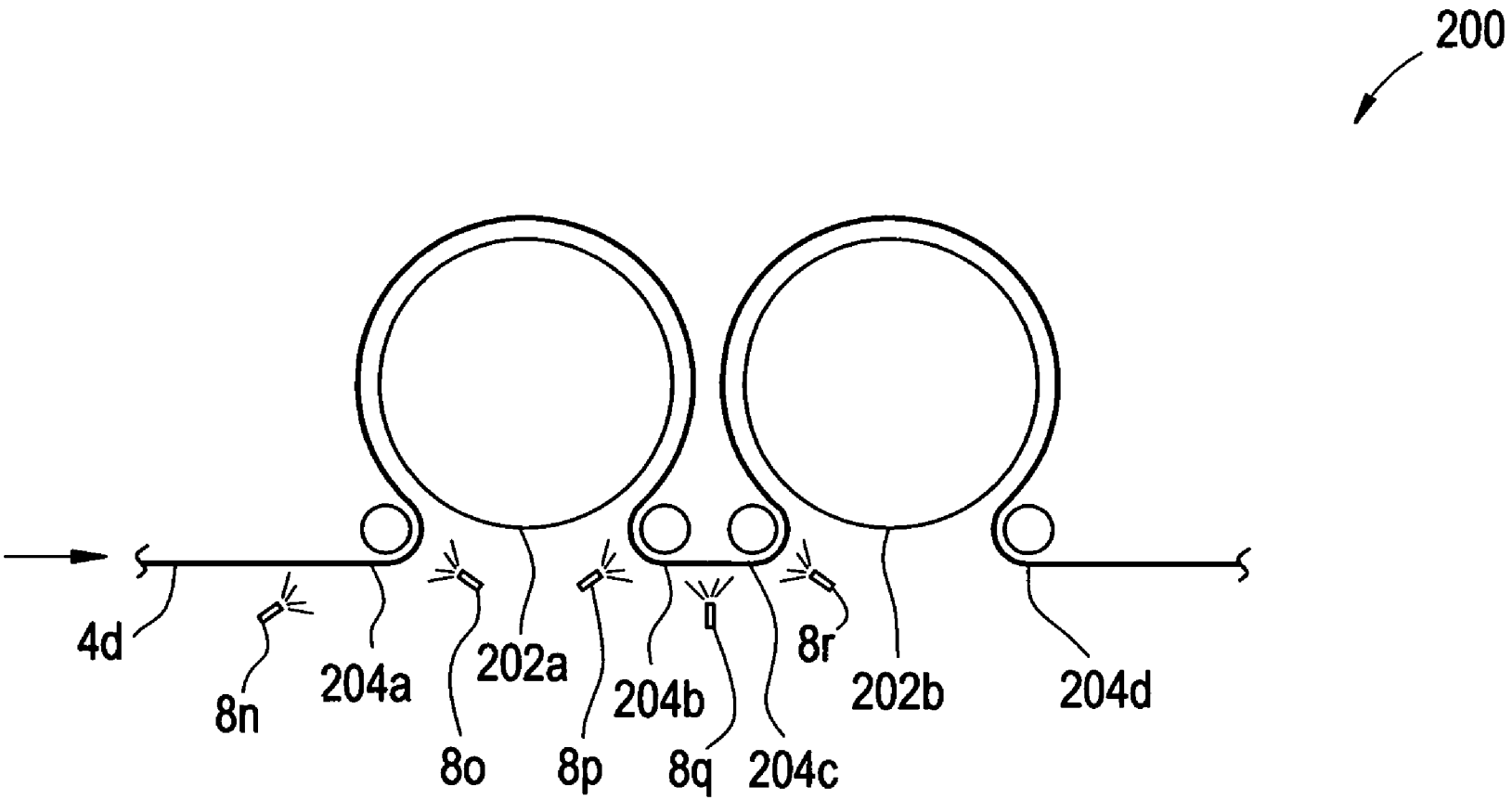
FIG. 4 shows an embodiment of implementing a method of the invention in a simplified side view schematic of an uncreped through-air dried papermaking process.

FIG. 4 illustrates a further embodiment of the invention in uncreped through-air dried ("UCTAD") process 200. The paper web travels along path 4*d*, over through-air driers 202*a* and 202*b* and over guide rollers 204*a* to 204*d* associated with the through-air driers. Though FIG. 4 indicates two through-air driers, implementation of the invention is not limited to such a limitation. It is contemplated that the UCTAD process may have one, two, or more through-air driers. Preferably, the UCTAD process utilizes two through-air driers. The paper web typically has from about 15 percent to about 25 percent consistency prior to entering the first through-air drier and about 70 percent consistency prior to entering the last (if more than one) through-air drier. The super-absorbent composition may be introduced at one or more of application points 8*n* to 8*r*. Preferably, the super-absorbent composition is introduced at application point 8*p*, 8*q*, or 8*r*, prior to the last through-air drier.

Figure 5:
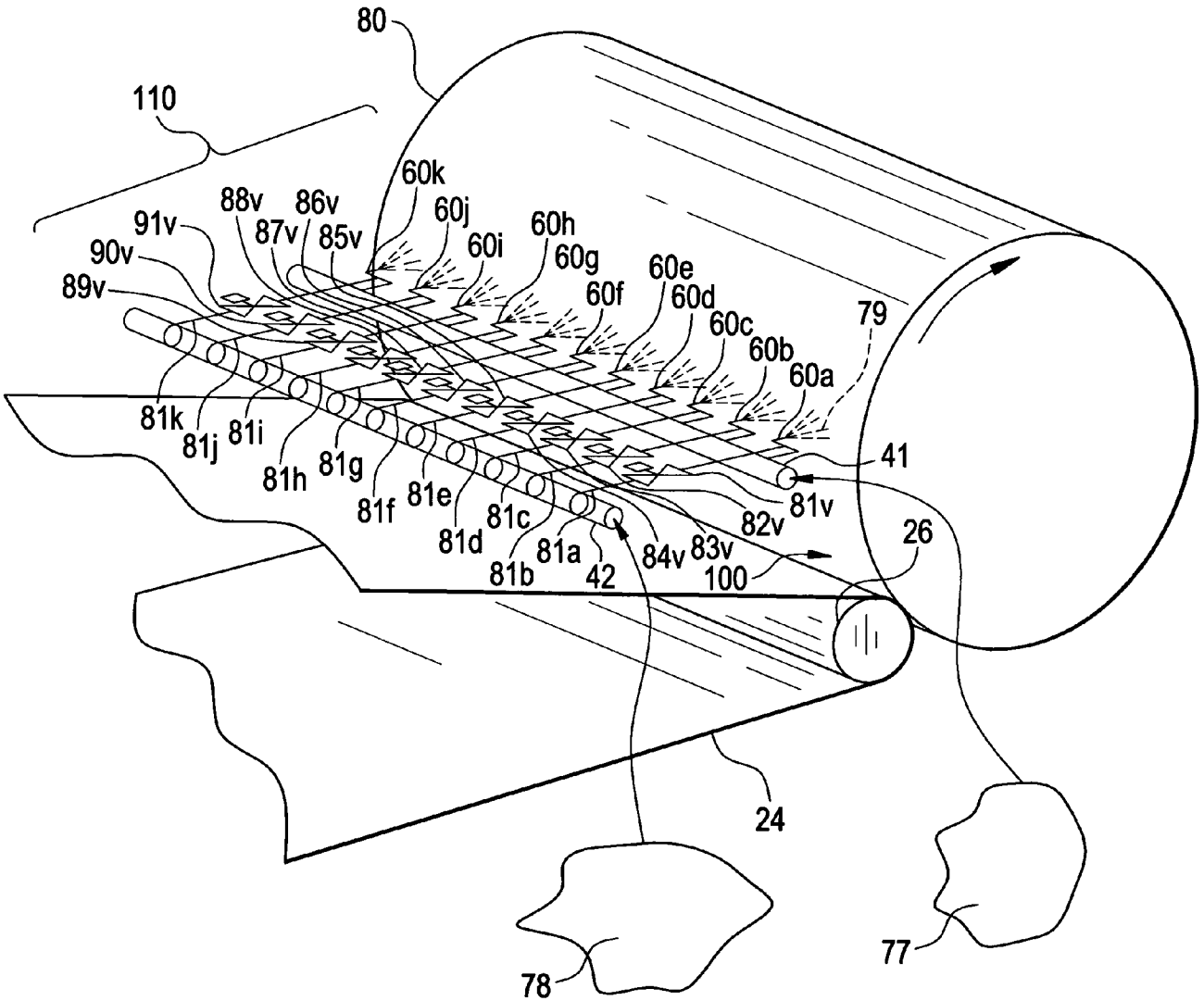
FIG. 5 is a schematic of a spray boom system embodiment used to apply a super-absorbent composition to a paper web.

Illustrated in FIG. 5 is an embodiment of spray apparatus or spray boom system 110 used to introduce the super-absorbent composition to the paper web. In this embodiment, the paper web is transferred to creping cylinder 80. It should be understood that the creping cylinder might be any type of cylinder, such as a heated drum or a through-air drier, in alternative embodiments. Primary spray boom 41 has primary pipes 60*a* to 60*k*, with attached spray nozzles that all apply super-absorbent composition from primary feed tank 77. In one embodiment, the spray boom system includes secondary spray boom 42 having secondary pipes 81*a* to 81*k*, which feed into the corresponding primary pipes 60*a* to 60*k*. Thus, it is possible to mix other processing agents with from secondary feed tank 78 prior to applying the super-absorbent composition to the paper web.

For example, the secondary feed tank may contain a cross-linking agent that is mixed with the super-absorbent composition from the primary feed tank. Alternatively, the primary feed tank may contain a mixture of a super-absorbent cross-linkable polymer and a cross-linking agent, and the secondary feed tank may contain additional processing agents. In one embodiment, the spray boom system includes one or more additional spray booms and/or one or more additional feed tanks. In another embodiment, the spray boom system has only the primary spray boom. In a further embodiment, the spray boom system has only the primary feed tank.

In the spray boom system of FIG. 5, it is also possible to close one, some, or all of check valves 81*v* to 91*v* to allow for directed mixing of materials from the secondary feed tank with only certain of the primary pipes 60*a* to 60*k*. This directed mixing allows applying different mixtures from the primary feed tank and the secondary feed tank to specified areas or portions of the paper web. Inclusion of check valves in the spray boom system on the primary pipes (not depicted in FIG. 5, but easily added to the equipment setup) makes it possible to apply the super-absorbent composition to specified areas or portions of the paper web while leaving the remaining areas of the paper web untreated. Using the apparatus depicted in FIG. 5 means it is possible to conduct the method of the invention in many different, useful ways. It should be understood, however, that the spray boom system in FIG. 5 is only one preferred embodiment of a spray boom system. It is contemplated that a variety of different apparatuses may be employed to introduce the super-absorbent composition to the paper web. Further, one or more such spray boom systems may be employed at various points in the papermaking system.

It should be appreciated that particular applications may require adjustment of the application point or point of introduction of the super-absorbent composition. The invention may also be implemented using any suitable device or application system to apply the super-absorbent composition to the paper web, such as a spray boom system, steam shower, or spray nozzle. The application system(s) may be associated with any of the heated drums, after-driers, or through-air driers in any suitable fashion. For example, the application system may reside between a guide roller and a heated drum, after-drier, or through-air drier or may be associated with a guide roller, such as immediately before or after guide roller. The application system may also be associated with, such as proximate to or immediately before, a heated drum, after-drier, or through-air drier. Alternatively, the application system(s) may be operated independently of these components.

Further, it is contemplated that the SAP may be applied at various stages, and during multiple stages, of the papermaking process including while the substrate is carried on the forming felt or TAD fabrics. The above examples are not intended to limit the point of application. The spray apparatus or spray boom system described in the above embodiments may have any number of spray nozzles, such as one, two, or up to 8 or more, and may be attached or proximate to any of the above-described papermaking systems in any suitable fashion. For example, the spray apparatus may be connected to a bracket or other attaching device proximate to the wet end hood, as illustrated in FIG. 1, attaching device 10. Alternatively, the spray apparatus or boom may be automated, manually controlled, and/or adjustable and may or may not be attached to any surface or other apparatus.

It is not intended that introducing the super-absorbent composition be limited to spraying. Other alternative methods of introducing the super-absorbent composition to the paper web include water spray; offset printing; gravure; flexographic; inkjet; digital printing; electrostatic transfer; immersion; coating or spreading with a blade, air knife, short dwell cast, or other spreading device; extrusion; impregnation with a curtain coater; foam application; roller fluid feeding; moving belt or fabric; the like; and combinations thereof. Preferred methods of applying the composition of the invention include spraying, foam coating, or printing onto the paper web or saturating into the paper web. A more preferred method of application is spraying, for example, by using a VAU series gas-atomizing spray boom or nozzle (available from Spraying Systems Co., Wheaton, Ill.).

Depending on the amount of the super-absorbent polymer applied, the coated surface is characterized by enhanced hydrophilicity and/or enhanced absorbency. In order to provide such enhanced absorbency properties, the amount of SAP applied is typically from about 0.25 weight percent to about 5 weight percent, preferably from about 0.5 weight percent to about 2 weight percent, and more preferably from about 0.75 weight percent to about 1.5 weight percent, based on dry substrate weight.

It should be appreciated that the treated paper web of the invention may also be subject to additional drying in the papermaking process. One or more drying units, such as drum dryers, steam dryers, infrared dryers, microwave dryers, radio frequency dryers, the like, and combinations thereof may be used to further dry the paper web and/or to further cure or cross-link the applied super-absorbent composition.

EXAMPLES

The foregoing may be better understood by reference to the following examples, which are intended for illustrative purposes and are not intended to limit the scope of the invention.

Example I

Table I lists the improvement in absorbent capacity of a tissue substrate when the super-absorbent composition was sprayed onto a wet paper web in laboratory scale experiments. The paper web had moisture content of about 60% (i.e., 40% consistency) prior to application of the super-absorbent composition. In this example, a polyacrylate polymer and cross-linking agent composition designated as PD2191M was used (available from H.B. Fuller Company® in St. Paul, Minn.). This composition contained both the cross-linkable polymer and cross-linking agent in the same formulation. The super-absorbent composition was applied with a Paasche® air brush (Model 200T-000) fitted with an AU-000 spray tip.

Absorbency can be categorized in terms of absorbent rate and absorbent capacity. Absorbent rate includes a measure of how fast the substrate absorbs a given quantity of liquid. The amount of liquid that a given quantity of substrate can absorb is typically referred to as absorbent capacity. Absorbent capacity was measured by cutting treated sheets to about a 2 inch by about 2.5 inch sheets. Stacks of 8 sheets were used per test. The stacks were weighed when dry and then immersed in a 25° C. water bath for 1 minute. The stacks were then blotted dry and weighed. Absorbent capacity was calculated by dividing the wet weight by the dry weight.

TABLE I

| Super-Absorbent (wt %, based on dry paper weight) | Absorbent Capacity (g $H_2O$/g fiber) | Increase in Absorbent Capacity (%) |
|---|---|---|
| 0 | 2.38 | 0 |
| 0.30 | 2.87 | 20.5 |
| 0.42 | 3.20 | 34.3 |
| 0.56 | 3.11 | 30.6 |
| 0.64 | 3.26 | 36.8 |
| 0.64 | 3.04 | 27.7 |
| 0.68 | 3.18 | 33.6 |
| 0.68 | 3.27 | 37.2 |
| 1.26 | 3.20 | 34.3 |

TABLE I-continued

| Super-Absorbent (wt %, based on dry paper weight) | Absorbent Capacity (g $H_2O$/g fiber) | Increase in Absorbent Capacity (%) |
|---|---|---|
| 1.32 | 3.22 | 35.4 |
| 1.47 | 3.18 | 33.5 |
| 4.32 | 3.26 | 37.0 |
| 5.60 | 3.65 | 53.3 |
| 5.88 | 3.54 | 48.6 |
| 5.92 | 3.57 | 49.8 |
| 6.07 | 3.40 | 42.7 |
| 6.82 | 3.33 | 40.1 |
| 7.07 | 3.51 | 47.5 |
| 7.14 | 3.65 | 53.6 |
| 7.78 | 3.45 | 44.8 |
| 8.18 | 3.62 | 51.9 |

Example II

This example demonstrates the effect of pH on absorbent capacity, as shown in Table II. The polymer used was a modified polyacrylic acid designated as PD2072G (available from H. B. Fuller Company® in St. Paul, Minn.). The polymer add-on level was 5 weight percent, based on dry paper. The cross-linking agent was ammonium zirconium carbonate (sold under the tradename Bacote 20® and available from Magnesium Elektron, Inc. in Flemington, N.J.). The cross-linking agent level was 10 weight percent, based on polymer solids. The pH was adjusted with either sulfuric acid or sodium hydroxide having concentrations of 10 percent or 50 percent, dependent upon the targeted pH value. The control sample was wetted with deionized water, which had a measured pH of 4.98. The polymer and cross-linking agent were added to laboratory scale paper sheets by immersing the sheets in a bath of the super-absorbent and cross-linking agent. Excess liquid was removed by pressing the sheets with a laboratory wringer using 50 pounds of applied weight.

TABLE II

| Sample pH | Absorbent Capacity (g $H_2O$/g fiber) | Change in Absorbent Capacity (%) |
|---|---|---|
| | Control | |
| 4.98 | 2.29 | 0 |
| | pH Adjusted Samples | |
| 4.18 | 2.20 | −3.9 |
| 5.18 | 2.45 | 7.0 |
| 6.06 | 2.55 | 11.4 |
| 6.98 | 2.84 | 24.0 |
| 8.01 | 3.30 | 44.1 |
| 9.09 | 3.24 | 41.5 |
| 9.98 | 3.29 | 43.7 |

Example III

The effect of cross-linking agent level on improvement in absorbent capacity is shown in Table III. The cross-linking agent is ammonium zirconium carbonate, as above, and the cross-linking agent concentration is expressed in weight percent based on polymer solids. The polymer was a modified polyacrylic acid designated, PD2072G, as above. The polymer add-on level to the paper web was 5 weight percent, based on solids. The polymer and cross-linking agent were added to laboratory scale paper sheets by immersing the sheets in a bath of the super-absorbent and cross-linking agent. Excess liquid was removed by pressing the sheets with a laboratory wringer using 50 pounds of applied weight.

TABLE III

| Cross-linker Level (%) | Absorbent Capacity (g $H_2O$/g fiber) | Increase in Absorbent Capacity (%) |
|---|---|---|
| 0 | 2.26 | 0 |
| 1 | 3.08 | 36.3 |
| 3 | 3.64 | 61.1 |
| 5 | 3.68 | 62.9 |
| 10 | 3.15 | 39.4 |

Example IV

A super-absorbent composition including polyacrylate polymer and ammonium zirconium carbonate cross-linking agent, as described in U.S. Pat. No. 6,686,414 B1 (incorporated herein by reference in its entirety) and commercially available from H. B. Fuller as product PD2191M, was introduced to a wet towel paper web using a VAU series (model 152) air atomizing spray nozzle (available from Spraying Systems Co. in Wheaton, Ill.) with a positive displacement pump. The composition was formulated into an aqueous solution having dry solids of 24 wt % and a viscosity of 1075 cPs at 25° C. A drum of SAP product was heated to 36° C. using a band heater. Atomizing pressure was 50 psig for Conditions 1 to 3 (60 psig for Condition 4) and control of the spray pattern was optimized at 40 psig. Two nozzles were used to spray the composition on the two outside edges of the towel substrate.

For Conditions 1 to 3, approximately 14 inches of the front edge and the back edge of each sheet was sprayed just prior to the sheet entering the wet end hood of the Yankee Dryer. For Condition 4, only the back edge was sprayed. The creped towel was collected on a reel and sent to a converting machine. The towel was slit into 11 inch widths and plied together to form a two-ply finished towel product, where the treated surfaces were on the inside of the finished product.

Subsequent testing of the converted towel showed an improvement in absorbent properties, as detailed in Table IV. Add-on wt % was calculated as a theoretical value, based on dry weight. Values for the amount of SAP found in the towel by extraction with boiling water ranged from 0.41% to 0.92%. All of the trial conditions where SAP was applied showed an increase in the average absorbent capacity of the towel. The largest average increase in absorbent capacity of about 7.5% occurred for Condition 2. Some individual values showed absorbent capacity increases as high as 15% for certain towels. The average absorbent rate of the SAP-treated towels did not change much from the control and remained close to a value of 2 seconds.

TABLE IV

| Condition | Pump Output Frequency | SAP (gph) | Add-on wt % | Extracted SAP in Towel (%) | Absorbent Capacity (g $H_2O$/g fiber) | Absorbent Rate (sec) |
|---|---|---|---|---|---|---|
| Control | — | — | — | 0 | 5.91 | 1.96 |
| 1-SAP | 43.3 | 6.5 | 0.84 | 0.41 | 6.34 | 2.21 |
| 2-SAP | 60 | 8.75 | 1.13 | 0.74 | 6.35 | 2.12 |
| 3-SAP | 90 | 9.75 | 1.26 | 0.92 | 6.28 | 1.96 |
| 4-SAP | 43.3 | 5.75 | 0.74 | 0.48 | 6.04 | 1.76 |

It should be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

The claimed invention is:

1. A method of increasing absorbency of an absorbent article produced in a papermaking process, said method comprising:

(a) providing a heated drum and one or more after-driers, wherein the heated drum includes a wet end hood and a dry end hood and wherein at least one of the one or more after-driers includes an after-drier super-absorbent composition application point and optionally the heated drum includes a heated drum super-absorbent composition application point before the wet end hood, (b) transferring a paper web to the heated drum; and (c) introducing an effective amount of a super-absorbent composition to the paper web with a gas-atomizing spray boom at an after-drier super-absorbent composition application point and optionally at the heated drum super-absorbent composition application point to form the treated paper web;

wherein the super-absorbent composition comprises a liquid polymer solution and a cross linker, the super-absorbent composition is heated just before it is introduced by an in-line booster heater to lower and optimize its a viscosity to between 50 and 50,000 cPs, and the super-absorbent composition only acquires its super-absorbent properties when it is heated by the heated drum.

2. The method of claim 1, wherein the papermaking process is a dry crepe papermaking process or a wet crepe papermaking process.

3. The method of claim 1, wherein the paper web is selected from the group consisting of: tissue substrates, towel substrates, and sanitary product substrates.

4. The method of claim 1, wherein a first surface of the paper web is in contact with the heated drum and a second surface of the paper web is not in contact with the heated drum, and introducing an effective amount of the super-absorbent composition to the second surface of the paper web at the heated drum super-absorbent application point to form the treated paper web.

5. The method of claim 1, wherein a first side of the paper web is in contact with each after-drier and a second side of the paper web is not in contact with each after-drier, and introducing an effective amount of the super-absorbent composition to the first side of the paper web at the after-drier super-absorbent composition application point to form the treated paper web.

6. The method of claim 1, in which the composition further comprises salt and has a viscosity of more than 2500 cPs before heating by the in-line booster heater and has its a viscosity drop to less than 600 cPs after the heating, and the viscosity drop is also in part due to salt in the composition and the heating occurs within a range of 30-60 degrees Celcius.

7. The method of claim 1, wherein the super-absorbent composition includes a cross-linkable polymer that is a homopolymer, copolymer, or terpolymer synthesized from $\alpha,\beta$-ethylenically unsaturated carboxylic acid monomers.

8. The method of claim 1, wherein the super-absorbent composition includes a cross-linkable polymer that is a homopolymer, copolymer, or terpolymer synthesized from monomers selected from the group consisting of acrylic acid; methacrylic acid; crotonic acid; maleic acid; itaconic acid; flumaric acid; mesaconic acid; aconitic acid; maleic anhydride; acrylamide; and combinations thereof.

9. The method of claim 1, including introducing additional super-absorbent composition to the paper web by using a means selected from the group consisting of: offset printing; gravure; flexographic; inkjet; digital printing; electrostatic transfer; immersion; coating or spreading with a blade, air knife, short dwell cast, or other spreading device; extrusion; impregnation with a curtain coater; foam application; roller fluid feeding; moving belt or fabric; and combinations thereof.

10. The method of claim 1, including selectively introducing the super-absorbent composition to only certain portions of the paper web.

11. The method of claim 1, including introducing from about 0.25 weight percent to about 5 weight percent of the super-absorbent composition to the paper web, based on dry weight.

12. The method of claim 1, wherein the super-absorbent composition includes additional cross-linking agents.

13. The method of claim 12, including introducing the additional cross-linking agents to the paper web or the treated paper web sequentially or simultaneously with the super-absorbent composition.

14. The method of claim 13, wherein the additional cross-linking agent comprises from about 1 weight percent to about 10 weight percent of the cross-linking agent as either part of the super-absorbent composition or separately from the super-absorbent composition, based on cross-linkable polymer.

15. The method of claim 14, including a cross-linking agent selected from the group consisting of: aluminum salts; chromium salts; titanium salts; iron salts; zirconium salts; epihalohydrins; dialdehydes; glycidyl ethers; polyglycidyl ethers; polyhaloalkanols; sulfonium zwitterions; haloepoxyalkanes; derivatives thereof; and combinations thereof.

16. The method of claim 1, wherein the super-absorbent composition includes one or more pH-adjusting agents selected from the group consisting of: sodium hydroxide; potassium hydroxide; ammonium hydroxide; hydrochloric acid; sulfuric acid; phosphoric acid; formic acid; citric acid; and combinations thereof.

17. The method of claim 1, wherein the absorbent article is characterized by about 5 to about 65 percent increased absorbency.

18. A method of increasing absorbency of an absorbent article produced in a papermaking process, said method comprising the steps of:

(a) providing one or more through-air driers including at least one super-absorbent composition application point;

(b) contacting a paper web with one or more through-air driers prior to said application point;

(c) introducing an effective amount of a super-absorbent composition to the paper web with a gas-atomizing spray boom to form a treated paper web at a super-absorbent composition application point; and (d) reintroducing an effective amount of the super-absorbent composition to the treated paper at another super-absorbent composition point, downstream from said at least one super-absorbent composition application point;

wherein the super-absorbent composition comprises a liquid polymer solution and a cross linker, the super-absorbent composition is heated just before it is introduced by an in-line booster heater to lower and optimize its viscosity to between 50 and 50,000 cPs and it only acquires its super-absorbent properties when it is heated by the heated drum.

19. The method of claim 18, wherein the papermaking process is a creped through-air dried papermaking process or an uncreped through-air dried papermaking process.

20. The method of claim 18, wherein a first side of the paper web is in contact with each through-air drier and a second side of the paper web is not in contact with each through-air drier, and including introducing an effective amount of the super-absorbent composition to the first side of the paper web.

21. The method of claim 18, in which there are at least two super-absorbent composition application points and step (d) occurs at a different super-absorbent composition application point than step (c).

22. A method of increasing absorbency of an absorbent article produced in a papermaking process, said method comprising (a) providing one or more super-absorbent composition application points; (b) performing one or more of the following steps:

(i) transferring a paper web to a heated drum including at least one of the super-absorbent composition application points, (ii) contacting the paper web with a through-air drier including at least one of the super-absorbent composition application points, (iii) contacting the paper web with an after-drier including at least one of the super-absorbent composition application points; and (c) introducing a super-absorbent composition to the paper web to form a treated paper web at one or more of said application points;

wherein the super-absorbent composition comprises a liquid polymer solution and a cross linker, the super-absorbent composition is heated just before it is introduced by an in-line booster heater to lower and optimize its viscosity to between 50 and 50,000 cPs and it only acquires its super-absorbent properties when it is heated by the heated drum and the super-absorbent composition is introduced to the paper web with a gas-atomizing spray boom at one or more of the super-absorbent composition application points.

* * * * *